US008326578B2

(12) United States Patent
Kawai et al.

(10) Patent No.: US 8,326,578 B2
(45) Date of Patent: Dec. 4, 2012

(54) EQUIPMENT MONITORING DEVICE AND REMOTE MONITORING SYSTEM

(75) Inventors: Seiji Kawai, Kusatsu (JP); Satoru Tamba, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 349 days.

(21) Appl. No.: 12/678,505

(22) PCT Filed: Sep. 25, 2008

(86) PCT No.: PCT/JP2008/002655

§ 371 (c)(1),
(2), (4) Date: Mar. 17, 2010

(87) PCT Pub. No.: WO2009/041039

PCT Pub. Date: Apr. 2, 2009

(65) Prior Publication Data

US 2010/0204958 A1 Aug. 12, 2010

(30) Foreign Application Priority Data

Sep. 27, 2007 (JP) ..... 2007-250332

(51) Int. Cl.
*G06F 15/00* (2006.01)

(52) U.S. Cl. ..... 702/185

(58) Field of Classification Search ..... 702/185
See application file for complete search history.

(56) References Cited

FOREIGN PATENT DOCUMENTS

| | | | |
|---|---|---|---|
| CN | 1563827 | A | 1/2005 |
| EP | 0 848 215 | A2 | 6/1998 |
| JP | 10-170056 | A | 6/1998 |
| JP | 2003-166745 | A | 6/2003 |

OTHER PUBLICATIONS

Hans-Gerd Brummel, Online Monitoring of Gas Turbine Power Plants, Siemens Power Generation, Siemens Corporate Research 2005, p. 1-24.*

Chinese Office Action of corresponding Chinese Application No. 200880108932.0 dated Mar. 19, 2012.

* cited by examiner

*Primary Examiner* — Tung S Lau
(74) *Attorney, Agent, or Firm* — Global IP Counselors

(57) ABSTRACT

An equipment monitoring device for monitoring equipment and transmitting an operational status of the equipment to a remote monitoring device that is provided in a remote location relative to the equipment includes an anomaly detection unit, an anomaly identifying unit and an anomaly reporting unit. The anomaly detecting unit is configured to detect an anomaly that occurs in the equipment. The anomaly identifying unit is configured to identify the anomaly based on at least one of an anomaly category and an anomaly level. The an anomaly reporting unit is configured to issue an anomaly report of the anomaly to the remote monitoring based on identification of the anomaly by the anomaly identifying unit.

6 Claims, 7 Drawing Sheets

500

| CATEGORY | LEVEL | UPDATING TIME | ELAPSED TIME | REPORT NECESSARY: 0 REPORT UNNECESSARY: 1 | |
|---|---|---|---|---|---|
| A | HIGH | 5 MINUTES | 4:35 | 1 | 511 |
| A | MEDIUM | 15 MINUTES | 16:50 | 0 | 512 |
| A | LOW | 30 MINUTES | 25:45 | 1 | |
| B | HIGH | 3 MINUTES | 3:10 | 0 | |
| B | MEDIUM | 10 MINUTES | 12:15 | 0 | |
| B | LOW | 25 MINUTES | 24:15 | 1 | |
| C | HIGH | 1 MINUTE | 20:03 | 0 | |
| C | MEDIUM | 10 MINUTES | 15:50 | 0 | |
| C | LOW | 20 MINUTES | 19:00 | 1 | |
| 501 | 502 | 503 | 504 | 505 | |

FIG. 5

EQUIPMENT MONITORING DEVICE AND REMOTE MONITORING SYSTEM

CROSS-REFERENCE TO RELATED APPLICATIONS

This U.S. National stage application claims priority under 35 U.S.C. §119(a) to Japanese Patent Application No. 2007-250332, filed in Japan on Sep. 27, 2007, the entire contents of which are hereby incorporated herein by reference.

TECHNICAL FIELD

The present invention relates to an equipment monitoring device and to a remote monitoring system.

BACKGROUND ART

Monitoring systems have been used in the past for receiving equipment information from an air conditioning device or other equipment and monitoring the operational status of the equipment. In such a monitoring system, an equipment monitoring device is provided in a building (property) in which the equipment is provided, and when the equipment monitoring device detects an anomaly in the equipment, an anomaly report is issued from the equipment monitoring device to a remote monitoring device that is provided at a remote location from the equipment. When the anomaly report is received by the remote monitoring device, anomaly information that relates to the anomaly report is sent to a manager or other person responsible for the equipment, and action is taken with respect to the anomaly. In such a monitoring system, a complex operation is involved in determining which reported anomaly to urgently respond to when a large number of anomaly reports are received by the remote monitoring device. An equipment monitoring device has therefore been proposed for restricting anomaly reports from the equipment monitoring device to the remote monitoring system when the detected subject of an anomaly is the same as that of a previously detected anomaly in order to reduce the amount of anomaly reports received by the remote monitoring device and make anomalies easier for a manager or the like to identify. See Japanese Laid-open open Patent Publication No. 10-170056, for example.

SUMMARY

Technical Problem

However, even when an equipment monitoring device such as the one described above is used to manage equipment remotely, the amount of information relating to anomalies that is sent to the manager or the like remains as large as before, and distinguishing between each item of information is complex.

An object of the present invention is to provide an equipment monitoring device or remote monitoring system whereby the number of anomaly reports issued from the equipment monitoring device to a remote monitoring device can be reduced, and information relating to anomalies that require an urgent response can easily be identified.

Solution to Problem

An equipment monitoring device according to a first aspect of the present invention is an equipment monitoring device for monitoring equipment and transmitting an operational status of the equipment to a remote monitoring device that is provided in a remote location relative to the equipment, and the equipment monitoring device comprises an anomaly detection unit, an anomaly identifying unit, and an anomaly reporting unit. The anomaly detection unit detects an anomaly that occurs in the equipment. The anomaly identifying unit identifies the anomaly on the basis of at least one of an anomaly category and an anomaly level. The anomaly reporting unit issues an anomaly report that is a report of the anomaly to the remote monitoring device, on the basis of the results of an identification made by the anomaly identifying unit. Anomalies in a "category" are anomalies that have the same type of subject; e.g., a failure of the same part, an anomaly detected by the same sensor, and the like. The "level" of an anomaly refers to the severity of an anomaly, such as "minor," or "severe," determined based on whether an anomaly requires an urgent response.

In the equipment monitoring device of the present invention, an anomaly report is issued to the remote monitoring device on the basis of the result of the anomaly identifying unit identifying the anomaly on the basis of at least one of the anomaly category and the anomaly level.

Consequently, the number of anomaly reports received by the remote monitoring device can be reduced, and anomalies that require an urgent response can easily be identified in the remote monitoring device.

An equipment monitoring device according to a second aspect of the present invention is the equipment monitoring device according to the first aspect of the present invention, wherein the anomaly identifying unit compares the category and the level of a reported anomaly which is the anomaly already reported to the remote monitoring device, and the category and the level of a new anomaly which is a newly detected the anomaly.

In the equipment monitoring device of the present invention, the anomaly reporting unit issues an anomaly report to the remote monitoring device on the basis of the result of comparison between the category and level of the new anomaly and the category and level of the already reported anomaly by the anomaly identifying unit.

Consequently, the amount of information to be processed by the remote monitoring device can be reduced by preventing redundant reception of anomalies that relate to an anomaly report already received by the remote monitoring device.

An equipment monitoring device according to a third aspect of the present invention is the equipment monitoring device according to the second aspect of the present invention, wherein the anomaly reporting unit does not issue the anomaly report to the remote monitoring device when the category of the new anomaly matches the category of the already reported anomaly, and at least one of the following cases occurs: the level of the new anomaly matches the level of the already reported anomaly, and the level of the new anomaly is lower than the level of the already reported anomaly.

In the equipment monitoring device of the present invention, anomaly reporting is restricted by the relationship between the level of the new anomaly and the level of an already reported anomaly when the category of the new anomaly and the category of the already reported anomaly are the same.

Consequently, since the equipment monitoring device does not issue an anomaly report for an anomaly having at least one of the same level as an already reported anomaly and a level lower than the level of an already reported anomaly, it is possible to reduce the amount of information relating to anomalies that is received by the remote monitoring device.

An equipment monitoring device according to a fourth aspect of the present invention is the equipment monitoring device according to the second or third aspect of the present invention, further comprising a condition acquiring unit. The condition acquiring unit acquires a non-reporting condition of the anomaly from the remote monitoring device. Information relating to the already reported anomaly is obtained based on the non-reporting condition acquired by the condition acquiring unit.

In the equipment monitoring device of the present invention, information relating to the already reported anomaly to be compared with a new anomaly is obtained according to a non-reporting condition of the anomaly that is acquired from the remote monitoring device.

Consequently, the non-reporting condition is updated in the remote monitoring device, and it is thereby possible to change the anomaly that is reported to the remote monitoring device from the equipment monitoring device. Even in the case of an already reported anomaly that has previously been reported from the equipment monitoring device to the remote monitoring device and has thus been disallowed from being reported to the remote monitoring device, for example, by subsequently changing the subject of the non-reporting condition acquired from the remote monitoring device, the anomaly can again be reported to the remote monitoring device.

An equipment monitoring device according to a fifth aspect of the present invention is the equipment monitoring device according to any of the first through fourth aspects of the present invention, further comprising a periodic reporting unit. The periodic reporting unit periodically transmits to the remote monitoring device at least one of an operational history that is a history of the operational status of the equipment, and a change history that is a history of changes in the anomaly.

In the equipment monitoring device of the present invention, since at least one of an operational history and a change history is transmitted to the remote monitoring device, the occurrence and resolution of an anomaly can be ascertained from the change history for an anomaly not reported to the remote monitoring device. The status of the equipment can thereby be efficiency monitored in the remote monitoring device without issuing an anomaly report every time an anomaly occurs.

A remote monitoring system according to a sixth aspect of the present invention is a remote monitoring system comprising an equipment monitoring device and a remote monitoring device, wherein the equipment monitoring device monitors an operational status of a unit of equipment, and the remote monitoring device is provided in a remote location relative to the equipment and receives information relating to the operational status from the equipment monitoring device. The equipment monitoring device comprises an anomaly detection unit, an anomaly identifying unit, and an anomaly reporting unit. The anomaly detection unit detects an anomaly that occurs in the equipment. The anomaly identifying unit identifies the anomaly on the basis of at least one of an anomaly category and an anomaly level. The anomaly reporting unit issues an anomaly report that is a report of the anomaly to the remote monitoring device, on the basis of the results of identification by the anomaly identifying unit.

In the remote monitoring system of the present invention, an anomaly report is issued to the remote monitoring device on the basis of the result of the anomaly identifying unit identifying the anomaly on the basis of at least one of the anomaly category and the anomaly level.

Consequently, the number of anomaly reports received by the remote monitoring device can be reduced, and anomalies that require an urgent response can easily be identified in the remote monitoring device.

A remote monitoring system according to a seventh aspect of the present invention is the remote monitoring system according to the sixth aspect of the present invention, wherein the remote monitoring device comprises an anomaly report receiving unit, a non-reporting condition generating unit, and a non-reporting condition transmitting unit. The anomaly report receiving unit receives the anomaly report. The non-reporting condition generating unit generates a non-reporting condition of the anomaly report in the equipment monitoring device on the basis of information relating to the anomaly report. The non-reporting condition transmitting unit transmits the non-reporting condition to the equipment monitoring device. The non-reporting condition generating unit also updates and generates the non-reporting condition on the basis of the level.

In the remote monitoring system of the present invention, the non-reporting condition is updated and generated according to the level of the anomaly received by the remote monitoring device, and the anomaly report from the equipment monitoring device is issued based on the non-reporting condition.

Since the timing of updating the non-reporting condition generated in the remote monitoring device therefore varies according to the level of the anomaly, by updating the non-reporting condition at a different time for severe anomalies and minor anomalies, for example, the system can be set so that minor anomalies are not reported for some time, so that severe anomalies are sequentially reported.

A remote monitoring system according to an eighth aspect of the present invention is the remote monitoring system according to the sixth or seventh aspect of the present invention, wherein the remote monitoring device comprises an anomaly information transmitting unit. The anomaly information transmitting unit automatically transmits the anomaly information to at least one of a manager and a dealer of the equipment when the anomaly report is received by the anomaly report receiving unit. The term "manager" refers to a property owner or other user of the equipment. The term "dealer" refers to an equipment sales outlet or a service station for maintaining the equipment.

In the remote monitoring system of the present invention, information relating to the anomaly report received by the remote monitoring device is automatically transmitted to at least one of a manager and a dealer of the equipment.

The manager or dealer can therefore appropriately assess the status of the equipment.

Advantageous Effects of Invention

Through the equipment monitoring device according to the first aspect of the present invention, the number of anomaly reports received by the remote monitoring device can be reduced, and anomalies that require an urgent response can easily be identified in the remote monitoring device.

Through the equipment monitoring device according to the second aspect of the present invention, the amount of information to be processed by the remote monitoring device can be reduced by preventing redundant reception of anomalies that relate to an anomaly report already received by the remote monitoring device.

Through the equipment monitoring device according to the third aspect of the present invention, since the equipment monitoring device does not issue an anomaly report for an anomaly having at least one of the same level as an already reported anomaly and a level lower than the level of an already reported anomaly, it is possible to reduce the amount of information relating to anomalies that is received by the remote monitoring device.

Through the equipment monitoring device according to the fourth aspect of the present invention, the non-reporting condition is updated in the remote monitoring device, and it is thereby possible to change the anomaly that is reported to the remote monitoring device from the equipment monitoring device.

Through the equipment monitoring device according to the fifth aspect of the present invention, the status of the equipment can be efficiency monitored in the remote monitoring device without issuing an anomaly report every time an anomaly occurs.

Through the remote monitoring system according to the sixth aspect of the present invention, the number of anomaly reports received by the remote monitoring device can be reduced, and anomalies that require an urgent response can easily be identified in the remote monitoring device.

Through the remote monitoring system according to the seventh aspect of the present invention, by updating the non-reporting condition at a different time for severe anomalies and minor anomalies, for example, the system can be set so that minor anomalies are not reported for some time, so that severe anomalies are sequentially reported.

Through the remote monitoring system according to the eighth aspect of the present invention, at least one of a manager and a dealer can appropriately assess the status of the equipment.

BRIEF DESCRIPTION OF THE DRAWINGS

FIG. 5 is a conceptual view used when the non-reporting condition generating unit according to an embodiment of the present invention updates the non-reporting condition.

DETAILED DESCRIPTION OF THE INVENTION

The remote monitoring system 100 according to a first embodiment of the present Invention will be described using FIGS. 1 through 7.

(Overall structure)

Figure 1:
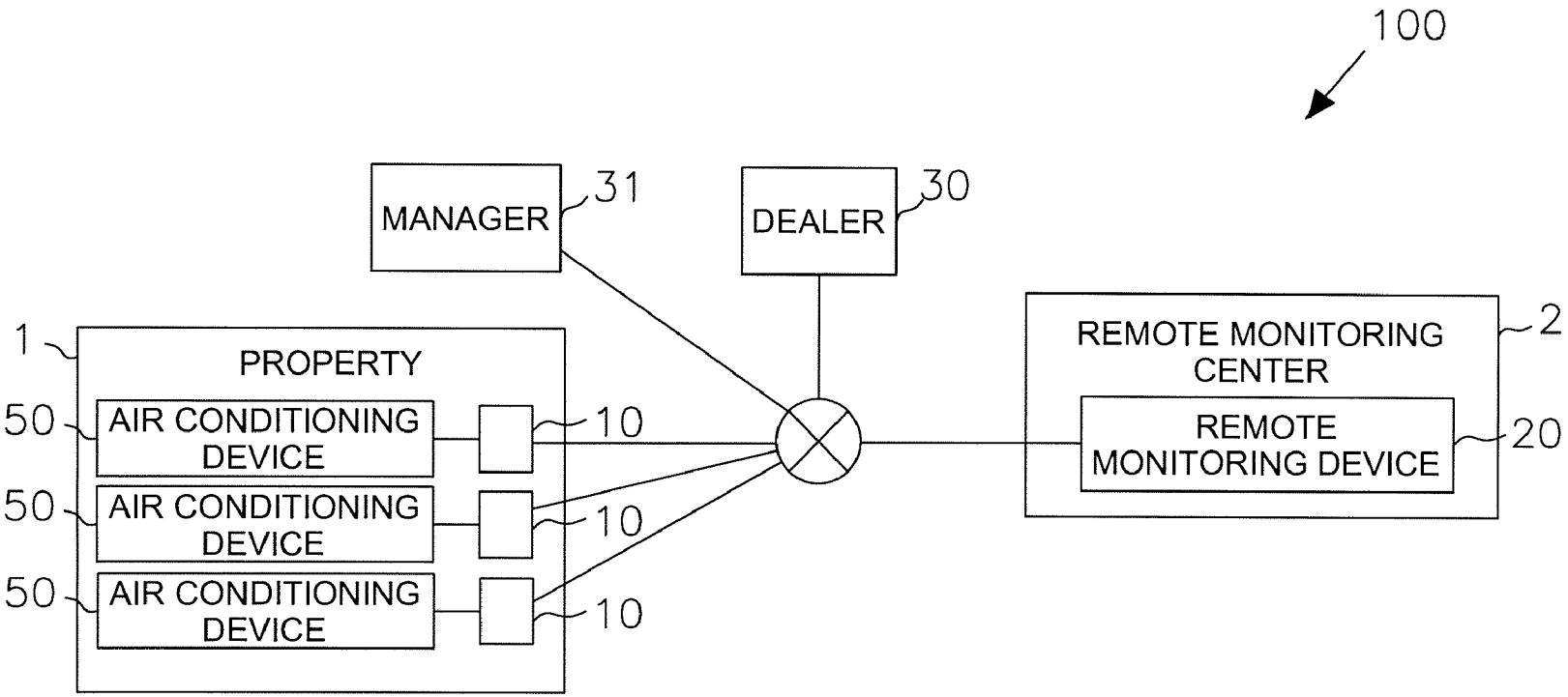
FIG. 1 is a view showing the overall structure of the remote monitoring system according to an embodiment of the present invention.

FIG. 1 shows the overall structure of the remote monitoring system 100. The remote monitoring system 100 is a system for managing air conditioning devices 50, which are provided to a property 1, from a remote monitoring device 20 inside a remote monitoring center 2. An equipment monitoring device 10 is connected to each of the air conditioning devices 50, and anomalies that occur in the air conditioning devices 50 are detected by the equipment monitoring devices 10. The equipment monitoring devices 10 and the remote monitoring device 20 are capable of communicating with each other via an Internet line, and equipment information indicating the operational state of the air conditioning devices 50, and anomaly information indicating an anomaly in the air conditioning devices 50 are transmitted from the equipment monitoring devices 10 to the remote monitoring device 20 via the Internet line. When anomaly information of the air conditioning devices 50 is received by the remote monitoring device 20, the anomaly information is transmitted via the Internet line from the remote monitoring device 20 to a dealer terminal 30 provided to a dealer of the air conditioning devices 50, and to a manager terminal 31 of a manager of the air conditioning devices 50. The term "manager" herein refers to a property owner or other user of the equipment. The term "dealer" refers to an equipment sales outlet or a service station for maintaining the equipment. The structure of each component will be described in detail hereinafter. The numbers of air conditioning devices 50, equipment monitoring devices 10, remote monitoring devices 20, and other components in the remote monitoring system 100 are not limited to the numbers of these components shown in FIG. 1.

(Structure of Each Component)

(1) Basic Structure of an Air Conditioning Device 50

Figure 2:
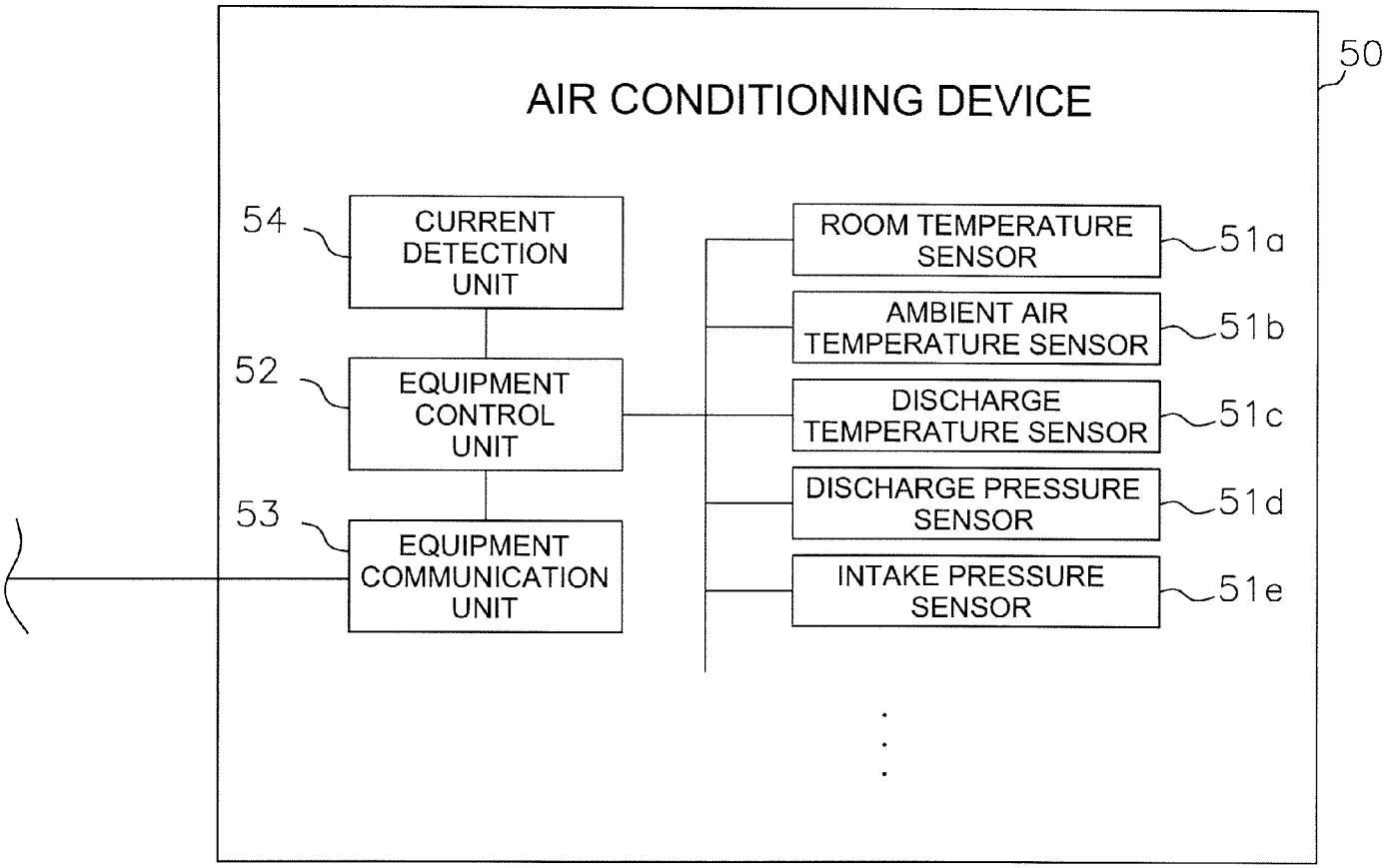
FIG. 2 is a view showing the structure of an air conditioning device according to an embodiment of the present invention.

The air conditioning device 50 in the remote monitoring system 100 will first be described using FIG. 2. The air conditioning device 50 has a refrigerant circuit composed of a compressor, a heat exchanger, and other components not shown in the drawing. Various sensors 51*a*, 51*b*, 51*c*, 51*d*, 51*e*, and so on are also attached to the air conditioning device 50. The sensor 51*a* detects the temperature of a room in which the air conditioning device 50 is provided. The sensor 51*b* detects the temperature of the ambient air in the vicinity of equipment to which the air conditioning device 50 is provided. The sensor 51*c* detects the discharge temperature, which is the temperature of the refrigerant in a discharge duct of the compressor that is included in the air conditioning device 50. The sensor 51*d* detects the discharge pressure, which is the pressure of the refrigerant in the discharge duct of the compressor that is included in the air conditioning device 50. The sensor 51*e* detects the intake pressure, which is the pressure of the refrigerant in an intake duct of the compressor that is included in the air conditioning device 50. A current detection unit 54 for detecting a current value is also attached to the air conditioning device 50.

The air conditioning device 50 also has an equipment control unit 52 and an equipment communication unit 53. The equipment communication unit 53 is connected to the equipment monitoring device 10, and transmits equipment information to the remote monitoring device 20 via the equipment monitoring device 10, as described above. The equipment control unit 52 controls the air conditioning device 50 according to control commands inputted from a user. The various sensors 51*a*, 51*b*, 51*c*, 51*d*, 51*e*, and so on and the current detection unit 54 are connected to the equipment control unit 52. The equipment control unit 52 transmits the values (equipment information) detected by the sensors 51*a*, 51*b*, 51*c*, 51*d*, 51*e*, and so on and the current detection unit 54 to the equipment monitoring device 10 at predetermined intervals (one minute in the present embodiment). The equipment control unit 52 also performs such operations as comparing the values acquired from the sensors 51*a*, 51*b*, 51*c*, 51*d*, 51*e*, and so on and current detection unit 54 with a predetermined threshold value at predetermined intervals (one minute in the present embodiment), and when an anomaly such as exceeding the predetermined threshold value is detected, the equipment control unit 52 transmits anomaly information indicating such to the equipment monitoring device 10.

(2) Structure of the Equipment Monitoring Device 10

Figure 3:
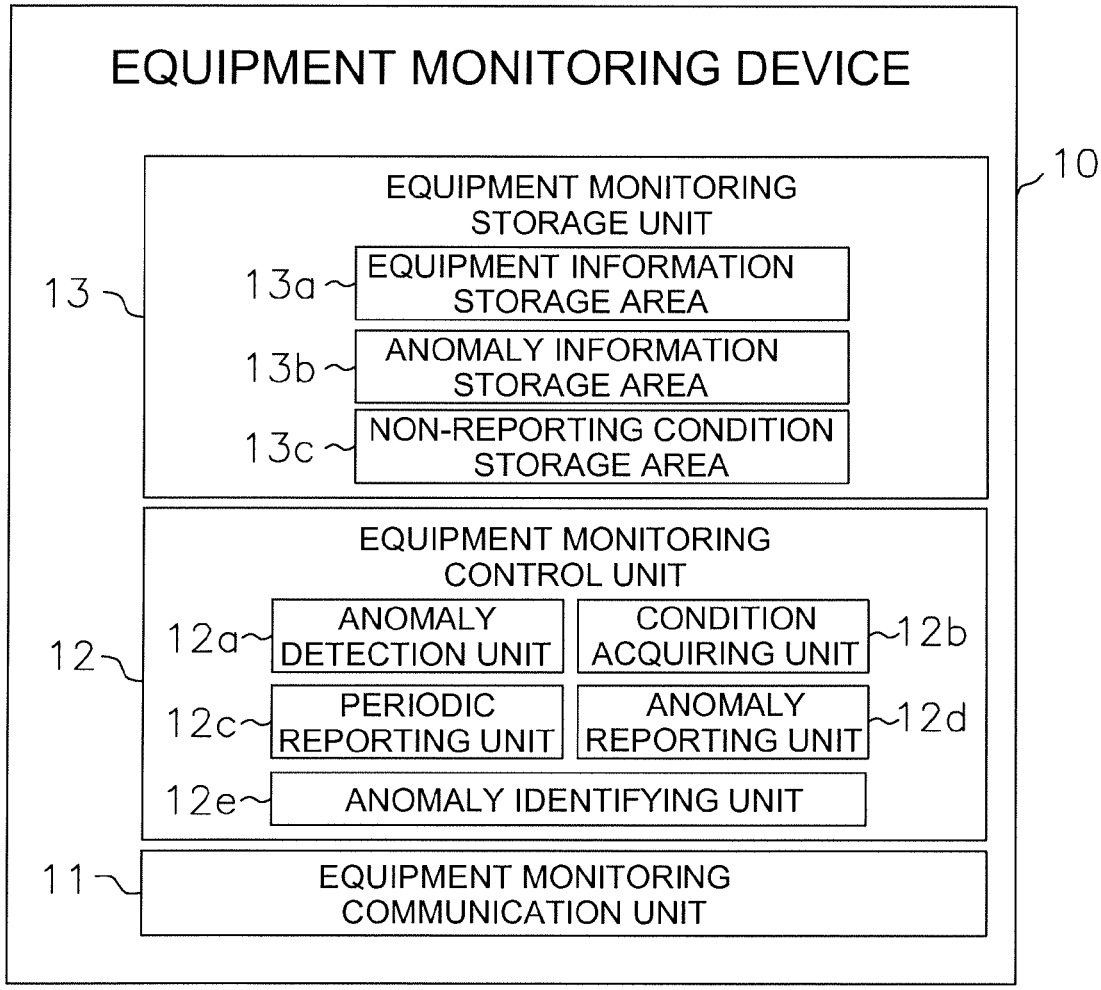
FIG. 3 is a view showing the structure of the equipment monitoring device according to an embodiment of the present invention.

As shown in FIG. 3, the equipment monitoring device 10 is primarily composed of an equipment monitoring communication unit 11, an equipment monitoring control unit 12, and an equipment monitoring storage unit 13. The equipment monitoring communication unit 11 is composed of a plurality of input/output ports. The equipment monitoring communication unit 11 is connected to the air conditioning device 50 and the remote monitoring device 20. The equipment monitoring communication unit 11 receives equipment information and anomaly information from the air conditioning device 50 and exchanges various signals with the remote monitoring device 20.

The equipment monitoring storage unit 13 maintains an equipment information storage area 13*a*, an anomaly information storage area 13*b*, and a non-reporting condition storage area 13*c*. Equipment information received from the air conditioning device 50 is stored in the equipment information storage area 13*a*. The term "equipment information" refers to device names, machine codes, operational history (indicating such information as how long a device has been operating in a certain operating mode (cooling mode, heating mode, fan mode, or the like)), values detected from the sensors 51*a*, 51*b*, 51*c*, 51*d*, 51*e*, and so on and the current detection unit 54, and addresses allocated for managing the air conditioning devices 50. Equipment anomaly information is stored in the anomaly information storage area 13*b*. An anomaly in the equipment is an anomaly in the various sensor values, an anomaly in a current value, or another anomaly. An anomaly in a sensor value is information indicating that a value detected in the sensors 51*a*, 51*b*, 51*c*, 51*d*, 51*e*, and so on has exceeded a predetermined threshold value. An anomaly in a current value is information indicating that a current value detected by the current detection unit has exceeded a predetermined threshold value. These items of information make it possible to determine that a flap motor in an air conditioning device 50 has failed, a short circuit has occurred, an anomaly has occurred in a compressor or fan motor provided to an outdoor unit, or that various other anomalies have occurred. The anomaly information storage area 13*b* has only enough storage capacity to enable stored information to be stored for a predetermined period (30 minutes in the present embodiment), and is configured so that the oldest information is deleted in sequence each time new information is acquired.

The equipment monitoring control unit 12 is primarily composed of an anomaly detection unit 12*a*, a condition acquiring unit 12*b*, a periodic reporting unit 12*c*, an anomaly reporting unit 12*d*, and an anomaly identifying unit 12*e*. The anomaly detection unit 12*a* detects anomaly information transmitted from the air conditioning device 50. The condition acquiring unit 12*b* acquires a non-reporting condition that relates to an anomaly report transmitted from the remote monitoring device 20. The non-reporting condition relating to the anomaly report is a condition referenced when the anomaly reporting unit 12*d* issues an anomaly report to the remote monitoring device 20. Specifically, the non-reporting condition cites an anomaly category and anomaly level for which an anomaly report to the remote monitoring device 20 is not necessary when an anomaly relating to the anomaly reports already received by the remote monitoring device 20 from the equipment monitoring device 10 is newly detected by the equipment monitoring device 10. The periodic reporting unit 12*c* transmits a change history and daily report once a day to the remote monitoring device 20. The term "change history" refers to a history of changes in the anomalies occurring in the air conditioning device 50, and the occurrence, resolution, time, and other characteristics of an anomaly are shown in the change history. The daily report indicates an operational history that is the history of the operational status of an air conditioning device 50, and the daily report is a summary of the operational history or operational state of the air conditioning device 50 for one day, based on the equipment information stored in the equipment information storage area 13*a* and the anomaly information stored in the anomaly information storage area 13*b*. The daily report specifically indicates the maximum and minimum values detected in the sensors 51*a*, 51*b*, 51*c*, 51*d*, 51*e*, and so on and current detection unit 54 for the day of the report, the cumulative operation time of the air conditioning device 50, the cumulative number of activations and deactivations, the maximum continuous operating time, and other operational details for the day of the report. The anomaly reporting unit 12*d* issues anomaly reports to the remote monitoring device 20. The anomaly reporting unit 12*d* issues anomaly reports to the remote monitoring device 20 on the basis of the results of identification by the anomaly identifying unit 12*e* described hereinafter. The anomaly identifying unit 12*e* compares an anomaly detected by the anomaly detection unit 12*a* with a non-reporting condition acquired from the remote monitoring device 20, and determines whether the anomaly is to be reported to the remote monitoring device 20. Specifically, the anomaly identifying unit 12*e* compares the category and level of a newly detected anomaly with the anomaly category and level indicated in the non-reporting condition, and identifies the newly detected anomaly. The anomaly category and anomaly level will both be described in the description of the non-reporting condition generating unit 25*b* in the remote monitoring device 20 described hereinafter. The anomaly reporting unit 12*d* does not issue an anomaly report to the remote monitoring device 20 when the category of the anomaly detected by the anomaly detection unit 12*a* is the same as the anomaly category indicated in the non-reporting condition, and the level of the anomaly detected by the anomaly detection unit 12*a* is the same as the anomaly level specified by the non-reporting condition.

(3) Basic Structure of the Remote Monitoring Device 20

Figure 4:
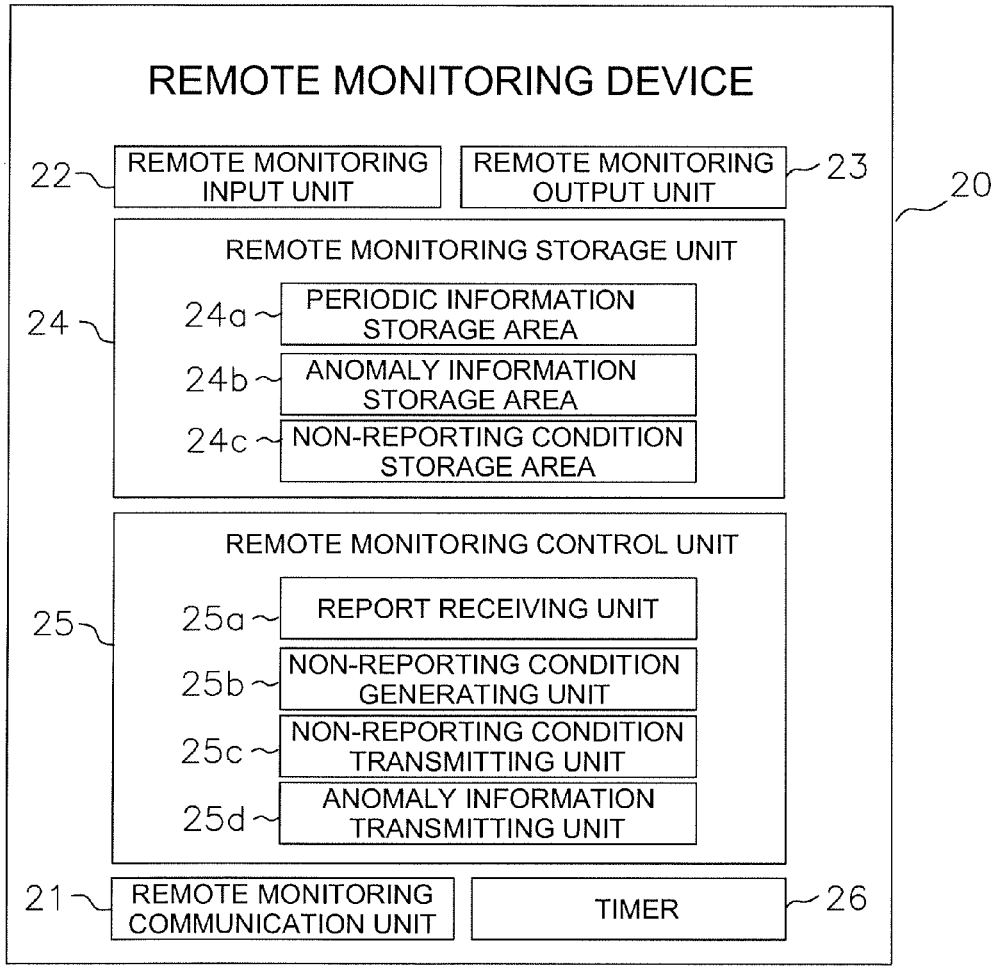
FIG. 4 is a view showing the structure of the remote monitoring device according to an embodiment of the present invention.

As shown in FIG. 4, the remote monitoring device 20 is primarily composed of a remote monitoring communication unit 21, a remote monitoring input unit 22, a remote monitoring output unit 23, a remote monitoring storage unit 24, a remote monitoring control unit 25, and a timer 26.

The remote monitoring communication unit 21 is composed of a plurality of input/output ports, and is connected to the equipment monitoring device 10, the dealer terminal 30, and the manager terminal 31 via an Internet line. The remote monitoring input unit 22 receives anomaly response results and various other data inputs. The anomaly response results and the like received by the remote monitoring input unit 22 are correlated with information relating to the anomaly and stored in the remote monitoring storage unit 24 described hereinafter. The remote monitoring output unit 23 is primarily composed of a display unit that constitutes a display, and a sound output unit that constitutes a speaker. The display unit displays a screen needed for the various operations of the remote monitoring device 20. The remote monitoring output unit 23 displays information indicating that an anomaly has occurred in the air conditioning device 50, as well as detailed information relating to the anomaly. The timer 26 measures the elapsed time since an anomaly report was received by an anomaly report receiving unit.

A periodic information storage area 24*a*, an anomaly information storage area 24*b*, and a non-reporting condition storage area 24*c*, primarily, are maintained in the remote monitoring storage unit 24. The change history and daily report reported by the periodic reporting unit 12*c* described above are stored in the periodic information storage area 24*a*. The anomaly information storage area 24*b* stores information relating to the anomaly reported by the anomaly reporting unit 12*d* described above. The non-reporting condition storage area 24*c* stores the non-reporting condition generated by the non-reporting condition generating unit 25*b* described hereinafter. The non-reporting condition thus stored is transmitted to the equipment monitoring device 10 by a non-reporting condition transmitting unit 25*c* described hereinafter.

The remote monitoring control unit 25 is primarily composed of a report receiving unit 25*a*, the non-reporting condition generating unit 25*b*, the non-reporting condition transmitting unit 25*c*, and an anomaly information transmitting unit 25*d*. The report receiving unit 25*a* has an anomaly report receiving unit (not shown) and a periodic report receiving unit (not shown). The anomaly report receiving unit receives an anomaly report transmitted from the equipment monitoring device 10, and the periodic report receiving unit receives the change history and daily report. The non-reporting condition generating unit 25*b* generates a non-reporting condition of the anomaly report in the equipment monitoring device 10 on the basis of information relating to the anomaly report received by the report receiving unit 25*a*. The non-reporting condition thus generated is the non-reporting condition acquired by the condition acquiring unit 12*b* of the equipment monitoring device 10, and is a condition for restricting anomaly reports from the equipment monitoring device 10 to the remote monitoring device 20. The non-reporting condition generating unit 25*b* generates a non-reporting condition on the basis of a past anomaly stored in the anomaly information storage area 24*b*, and updates the non-reporting condition according to the category and level of the past anomaly. Anomalies in a "category" are anomalies that have the same type; e.g., a failure of the same part, an anomaly detected by the same sensor, and the like. The "level" of an anomaly refers to the severity of an anomaly, such as "minor," or "severe," and are arbitrarily determined based on whether an anomaly requires an urgent response. For example, a minor anomaly is an anomaly not related to control of the refrigerant circuit of the air conditioning device 50, and that does not require an urgent response, such as failure of a flap motor, an anomaly in an intake sensor of one indoor unit when a plurality of indoor units are present, or a failure of some sensors when a plurality of the same type of sensors is provided, for example. Anomalies having a level such that there is no need for the manager or dealer of the air conditioning devices 50 to continuously keep track of such anomalies may also be considered as minor anomalies. A severe anomaly is an anomaly that is related to control of the refrigerant circuit, and that has a level that requires an urgent response, such as a discharge sensor anomaly, an anomaly in a compressor provided to an outdoor unit, or a fan motor anomaly, for example. The non-reporting condition is updated by the non-reporting condition generating unit 25*b* at a different timing depending on the type and level of the anomaly.

Updating of the non-reporting condition by the non-reporting condition generating unit 25*b* will next be described using FIG. 5. FIG. 5 is a conceptual view showing the relationship between the anomaly category (column 501), the anomaly level (column 502), the updating time (column 503) corresponding to the anomaly category and anomaly level, the elapsed time (column 504) measured by the abovementioned timer 26, and the necessity (column 505) of an anomaly report from the equipment monitoring device 10 as determined by the relationship between the updating time and the elapsed time. Among these items of information, the anomaly category, the anomaly level, and the updating time can be arbitrarily set by the manager of the remote monitoring center 2 to reflect the needs of a customer (dealers and air conditioning device 50 managers), and these set items of information are stored in the remote monitoring storage unit 24. The elapsed time (column 504) indicates the time elapsed since the last anomaly report having the corresponding category and level was received by the remote monitoring device 20. As shown in line 511, 4 minutes and 35 seconds have elapsed since the last report of an anomaly having a set updating time of 5 minutes (category: A, level: high) was received from the equipment monitoring device 10. Line 511 also indicates that an anomaly report to the remote monitoring device 20 is unnecessary when the equipment monitoring device 10 detects an anomaly having the same category (category: A) and same level (level: high) as the anomaly indicated by the condition of the air conditioning device 50. The equipment monitoring device 10 therefore does not issue an anomaly report to the remote monitoring device 20 in this case even when an anomaly of category "A" and level "high" is detected by the equipment monitoring device 10. On the other hand, according to line 512, 16 minutes and 50 seconds have elapsed since the last report of an anomaly having a set updating time of 15 minutes (category: A, level: medium) was received from the equipment monitoring device 10. Line 512 also indicates that an anomaly report to the remote monitoring device 20 is necessary when the equipment monitoring device 10 detects an anomaly having the same category (category: A) and same level (level: medium) as the anomaly indicated by the condition of the air conditioning device 50. The equipment monitoring device 10 therefore issues an anomaly report to the remote monitoring device 20 in this case when an anomaly in the air conditioning device 50 is detected by the equipment monitoring device 10. The elapsed time (column 504) measured by the timer 26 is reset after the non-reporting condition is transmitted to the equipment monitoring device 10.

The anomaly information transmitting unit 25*d* automatically transmits information relating to the anomaly information to at least one of the dealer terminal 30 and the manager terminal 31 when the anomaly report receiving unit receives the anomaly report from the equipment monitoring device 10.

(Sequence of Processing When an Anomaly Occurs)

The sequence of processing that takes place in the equipment monitoring device 10 when an anomaly in an air conditioning device 50 is detected will next be described using FIGS. 6 and 7.

A. Sequence of Control in the Equipment Monitoring Device 10

Figure 6:
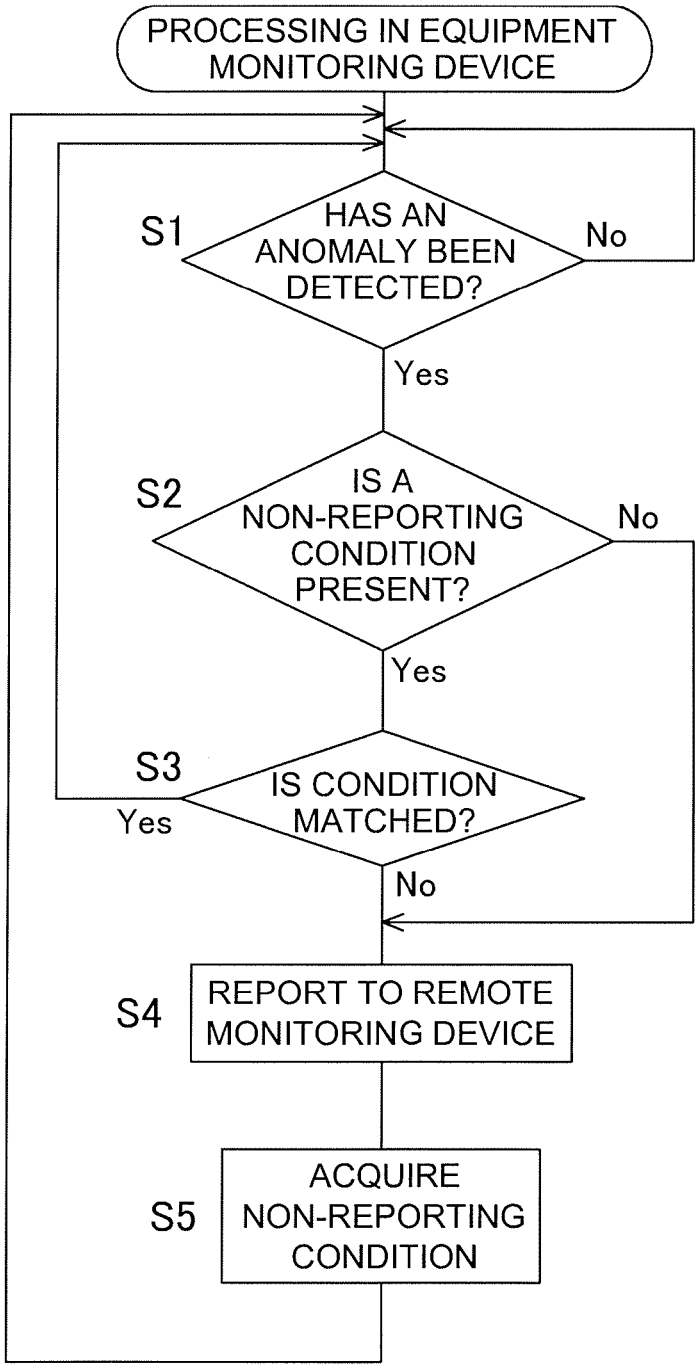
FIG. 6 is a view showing the sequence of processing in the equipment monitoring device according to an embodiment of the present invention.
Figure 7:
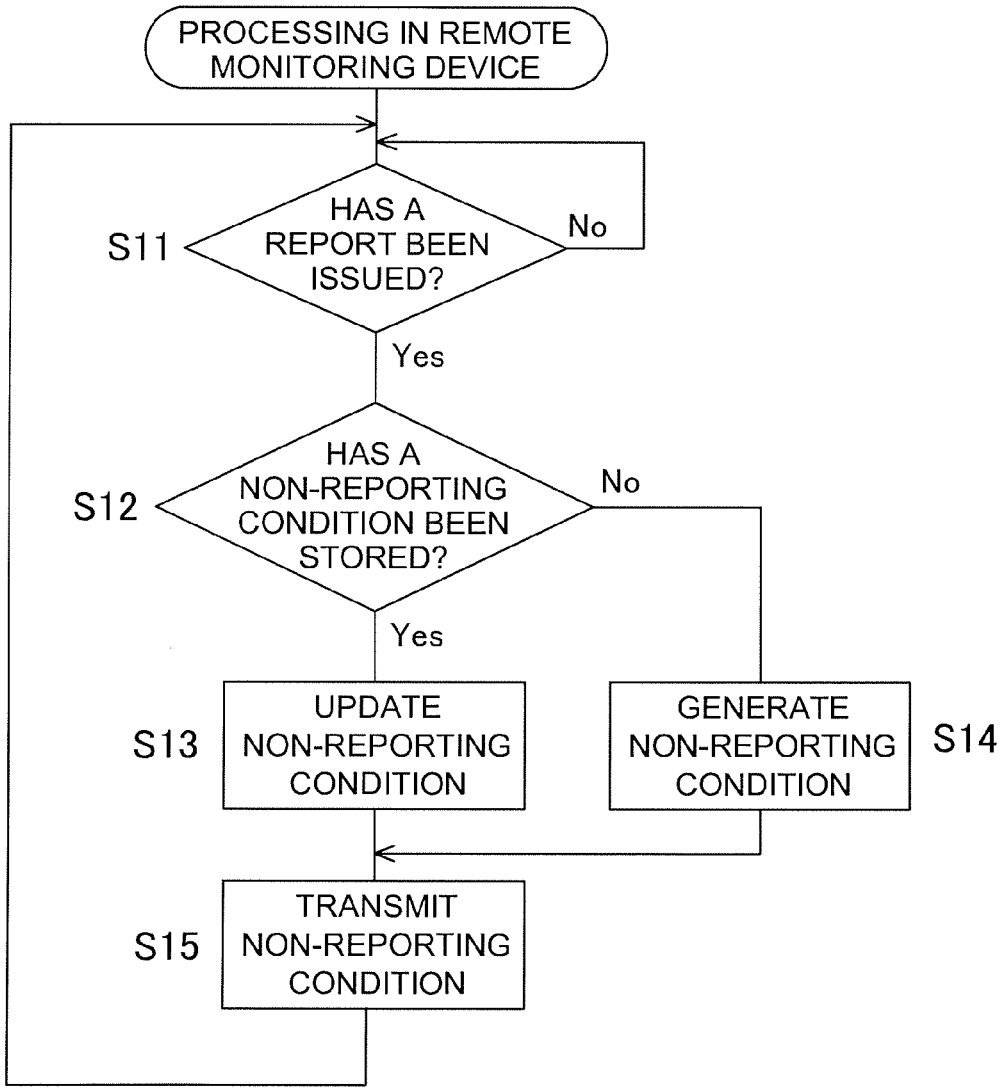
FIG. 7 is a view showing the sequence of processing in the remote monitoring device according to an embodiment of the present invention.

As shown in FIG. 6, when an anomaly in the air conditioning device 50 is detected by the anomaly detection unit 12*a* (step S1), the anomaly identifying unit 12*e* confirms whether a non-reporting condition is stored in the non-reporting condition storage area 13*c* (step S2). When a non-reporting condition is stored, the anomaly identifying unit 12*e* determines whether the anomaly detected by the anomaly detection unit 12*a* matches the non-reporting condition stored in the non-reporting condition storage area 13*c* (step S3). When the detected anomaly does not match the non-reporting condition, an anomaly report is issued to the remote monitoring device 20 (step S4), and when the detected anomaly matches the non-reporting condition, an anomaly report is not issued. When a determination is made in step S2 that a non-reporting condition is not stored, the process proceeds to step S4, and an anomaly report is issued to the remote monitoring device 20. When the anomaly report is issued to the remote monitoring device 20, the non-reporting condition subsequently transmitted from the remote monitoring device 20 is acquired (step S5).

B. Sequence of Control in the Remote Monitoring Device 20

The sequence of control in the remote monitoring device 20 will next be described using FIG. 7.

When an anomaly report is received in the remote monitoring device 20 (step S11), the non-reporting condition generating unit 25*b* confirms whether a non-reporting condition is stored in the non-reporting condition storage area 24*c* (step S12). When a non-reporting condition is stored, the non-reporting condition generating unit 25*b* updates the non-reporting condition (step S13). When confirmation is made in step S12 that a non-reporting condition is not stored, the non-reporting condition generating unit 25*b* generates a non-reporting condition (step S14). When the non-reporting condition is updated or generated in step S13 or step S14, the non-reporting condition transmitting unit 25*c* transmits the non-reporting condition to the equipment monitoring device 10 via the remote monitoring communication unit 21 (step S15).

(Characteristics)

(1) In the remote monitoring system 100 of the present invention, an anomaly reported to the remote monitoring device 20 from the equipment monitoring device 10 is compared with the category and level of an already reported anomaly. When the detected new anomaly has the same category as an anomaly indicated by the non-reporting condition, which is based on an already reported anomaly, and has the same level as the already reported anomaly, the equipment monitoring device 10 does not issue an anomaly report to the remote monitoring device 20. The number of anomaly reports transmitted from the equipment monitoring device 10 to the remote monitoring device 20 can thereby be reduced, and anomalies that require an urgent response can therefore be easily identified in the remote monitoring device 20.

Furthermore, in the remote monitoring system 100 of the present embodiment, when the anomaly of the air conditioning device 50 detected by the equipment monitoring device 10 is transmitted to the remote monitoring device 20, information relating to the anomaly is automatically transmitted to the manager terminal 31 and/or the dealer terminal 30. Therefore, by restricting the anomaly reports received by the remote monitoring device 20, the amount of information relating to anomalies that is transmitted to the manager terminal 31 and/or dealer terminal 30 is also restricted, and the complexity of responding to anomalies can therefore be reduced in each terminal 30, 31.

(2) The equipment monitoring device 10 according to the present embodiment acquires a non-reporting condition generated by the remote monitoring device 20 at the time of anomaly reporting. The non-reporting condition has a different updating time depending on the category and level of the anomaly. The manager of the remote monitoring center 2 can also set the updating time to reflect the needs of a customer. It is therefore possible to appropriately respond to the needs of a customer by changing the updating time between anomalies that require an immediate response and constant monitoring, and anomalies that are known and do not require confirmation for a certain amount of time.

(3) Furthermore, in the remote monitoring system 100 according to the present embodiment, operational history that is a history of the operational status of the air conditioning device 50, and change history that is a history of changes in an anomaly are periodically transmitted from the equipment monitoring device 10 to the remote monitoring device 20. The status of the air conditioning device 50 can therefore be efficiently assessed in the remote monitoring center 2 even in the remote monitoring system 100 of the present embodiment, in which not all anomalies detected by the equipment monitoring device 10 are reported to the remote monitoring device 20.

(Modifications)

(1) In the embodiment described above, the equipment managed by the equipment monitoring device 10 may be equipment other than an air conditioning device 50. For example, the equipment may be power supply equipment, a water supply and drainage device, an elevator, an illumination device, a disaster prevention device, a crime prevention device, or the like, or may be a combination of a plurality of types of equipment.

(2) In the present embodiment, the equipment monitoring device 10, remote monitoring device 20, dealer terminal 30, and manager terminal 31 may be connected by a line other than an Internet line. For example, these components may be connected by a telephone line. The dealer terminal 30 and the manager terminal 31 also need not be connected to the equipment monitoring device 10 and remote monitoring device 20.

(3) In the remote monitoring system 100 according to the present embodiment, anomaly reports from the equipment monitoring device 10 are issued based on a non-reporting condition transmitted from the remote monitoring device 20, and an anomaly report from the equipment monitoring device 10 is restricted when the anomaly has the same category and level as an anomaly indicated in the non-reporting condition. However, anomaly reporting is not limited to being restricted according to whether the anomaly has the same level as an anomaly indicated in the non-reporting condition, and a configuration may be adopted in which reporting is restricted for anomalies having the same level and lower levels than the anomaly indicated in the non-reporting condition. The number of anomaly reports received by the remote monitoring device 20 can thereby be even further reduced, thereby making it even easier to respond to assess the operational status of the air conditioning device 50 and respond to anomalies. A configuration may also be adopted in which high-level anomalies that require an urgent response are always considered necessary to report.

(4) In FIG. 5, the anomaly levels are classified as "high, medium, and low," but the anomaly levels are not limited to this classification, and may be classified as desired by the manager of the remote monitoring center 2. For example, anomalies may be classified into two levels, "minor" and "severe."

(Other Embodiments)

Embodiments of the present invention are described above based on the drawings, but the specific configuration of the present invention is not limited to these embodiments and may be modified within the scope of the invention.

Industrial Applicability

The present invention is useful as an equipment monitoring device and remote monitoring system whereby the number of anomaly reports from the equipment monitoring device to a remote monitoring device can be reduced, and information relating to anomalies that require an urgent response can easily be identified.

what is claimed is:

1. A remote monitoring system comprising:

an equipment monitoring device configured to monitor an operational status of a unit of equipment; and a remote monitoring device configured to receive information relating to the operational status from the equipment monitoring device, the remote monitoring device being provided in a remote location relative to the equipment, the equipment monitoring device including an anomaly detection unit configured to detect an anomaly that occurs in the equipment;

an anomaly identifying unit configured to identify the anomaly based on at least one of an anomaly category and an anomaly level which are indicated in a non-reporting condition transmitted from the remote monitoring device, the non-reporting condition being a condition for restricting an anomaly report of the anomaly to the remote monitoring device; and an anomaly reporting unit configured to issue the anomaly report of the anomaly to the remote monitoring based on identification of the anomaly by the anomaly identifying unit, and the remote monitoring device including an anomaly report receiving unit configured to receive the anomaly report, a non-reporting condition generating unit configured to generate and update the non-reporting condition based on the anomaly category and the anomaly level of the anomaly report, and a non-reporting condition transmitting unit configured to transmit the non-reporting condition to the equipment monitoring device.

2. The remote monitoring system according to claim 1, wherein the non-reporting condition generating unit is configured to generate the non-reporting condition based on the anomaly category and the anomaly level of each of a plurality of anomaly reports set in response to the needs of a customer, and is configured to update the non-reporting condition at a different timing in response to the needs of the customer.

3. The remote monitoring system according to claim 1, further comprising:

a periodic reporting unit configured to periodically transmit to the remote monitoring device at least one of an operational history of the operational status of the equipment, and an anomaly change history.

4. The remote monitoring system according to claim 2, wherein the anomaly identifying unit is configured to compare the anomaly category and the anomaly level which are indicated in the non-reporting condition to a new anomaly category and a new anomaly level which are the category and the level of the anomaly which is newly detected by the anomaly detection unit.

5. The remote monitoring system according to claim 3, wherein the remote monitoring device further includes an anomaly information transmitting unit configured to automatically transmit the anomaly information to at least one of a manager and a dealer of the equipment when the anomaly report is received by an anomaly report receiving unit.

6. The remote monitoring system according to claim 4, wherein the anomaly reporting unit is configured to not issue the anomaly report to the remote monitoring device when the new anomaly category matches the anomaly category indicated in the anomaly report and at least one of the following occurs the new anomaly level matches the anomaly level indicated in the anomaly report, and the new anomaly level is lower than the anomaly level indicated in the anomaly report.

* * * * *